US006265703B1

(12) United States Patent
Alton

(10) Patent No.: US 6,265,703 B1
(45) Date of Patent: Jul. 24, 2001

(54) ARC SUPPRESSION IN WAVEGUIDE USING VENT HOLES

(75) Inventor: William J. Alton, Pepperell, MA (US)

(73) Assignee: The Ferrite Company, Inc., Hudson, NH (US)

( * ) Notice: Subject to any disclaimer, the term of this patent is extended or adjusted under 35 U.S.C. 154(b) by 0 days.

(21) Appl. No.: 09/586,158

(22) Filed: Jun. 2, 2000

(51) Int. Cl.[7] ..... H05B 6/70

(52) U.S. Cl. ..... 219/736; 219/690; 219/746; 219/756; 219/757; 333/239; 333/249

(58) Field of Search ..... 219/690, 693, 219/695, 696, 697, 698, 699, 700, 736, 738, 746, 756, 757; 333/239, 248, 249, 251, 157

(56) References Cited

U.S. PATENT DOCUMENTS 3,541,289 * 11/1970 Smith ..... 219/700
3,622,733 * 11/1971 Smith ..... 219/692
3,916,317 * 10/1975 Jurgensen ..... 219/701
5,438,183 * 8/1995 Hayami et al. ..... 219/746

FOREIGN PATENT DOCUMENTS 2-46692 * 2/1990 (JP) .
2-302507 * 12/1990 (JP) .

* cited by examiner

*Primary Examiner*—Philip H. Leung
(74) *Attorney, Agent, or Firm*—Hamilton, Brook, Smith & Reynolds, P.C.

(57) ABSTRACT

A technique for passive suppression of arcs within a microwave frequency waveguide section. The waveguide is configured to have a bend at a point where the naturally, relatively high location occurs within the run. The bend at the high point causes arcs to be trapped as heat naturally collects within the waveguide at such predictable locations. Vent holes formed in the exterior portion of the waveguide at this point allow trapped hot air gases to escape, and cause the arc to be drawn towards the sidewall of the waveguide at a point where the voltage approaches zero. Presenting this region of zero voltage to the arc causes the arc to extinguish itself.

14 Claims, 5 Drawing Sheets

ARC SUPPRESSION IN WAVEGUIDE USING VENT HOLES

BACKGROUND OF THE INVENTION

This invention relates to a technique for suppressing arcs in an electromagnetic waveguide, and more particularly to a passive technique that introduces vent holes at a high point in a waveguide run.

Waveguides have been used for some time as an efficient way to carry microwave frequency energy over distances in a predictable manner. However, waveguides in some instances have a tendency to experience unpredictable behaviors such as internal arcing. In particular, even though a waveguide is sized to be capable of operating safely at the expected power levels without introducing a voltage breakdown, certain events or faults may occur to cause an energy discharge within the waveguide itself. Such faults may happen when dust, dirt or other ambient conditions introduce an abnormal voltage condition inside the waveguide. Such arcing is of concern since it may actually continue after the fault is no longer in existence. The arc not only partially blocks transmission of energy through the waveguide, but also may damage other system components.

For example, electromagnetic energy normally travels within the waveguide from an electromagnetic energy source through the waveguide towards a system that makes use of the microwave energy, such as a microwave oven cavity. Once an arc occurs, it tends to travel backwards within the waveguide, back towards the power source. The arc acts to reflect at least some electromagnetic energy back to the power source. This causes a decrease in power levels at points in the waveguide beyond the arc, meaning that the system in turn receives electromagnetic energy at a reduced power level.

A number of methods have been used in the past to detect and deal with the occurrence of an arc within a waveguide. For example, detectors may be attached to the waveguide which are responsive to the vibratory and electromagnetic disturbances resulting from an arc. The detectors can be arranged not only to determine the existence of an arc but also its location and velocity.

Upon detection of an arc, electronic control circuits can then be used to shut off the microwave power source or reduce its level so that the arcing will eventually cease. After a suitable delay, to allow any ionization caused by the arc within the waveguide to dissipate, the power source is then brought back on line again.

SUMMARY OF THE INVENTION

Arcing can be especially problematic in certain end uses such as microwave ovens. For example, in industrial process type microwave ovens that are used in large scale cooking applications, continuous and predictable microwave energy levels are required to produce a predicable end result of the cooking process. Any need to shut down the oven to extinguish an arc can therefore be very undesirable.

Consider that an arc tends to heat the air in its immediate vicinity within the waveguide. Since this hot air naturally rises, an arc will also tend to rise due to the heat in the ionized gases of the arc. When an arc traveling backwards towards a power source, encounters a bend in the waveguide, certain behavior is therefore observed under certain conditions. In particular, when the arc moves into a section of the waveguide where further travel backwards towards the source would involve moving downward in elevation, the arc will often become trapped by the rising effect of the hot air associated with the arc. At such a point, the force of the rising hot air on the arc actually opposes the electromagetic force that urges the arc to travel backwards.

Such arcs may therefore tend to set up in a stationary or stable location within the waveguide at a bend where further backwards travel would involve downwards movement. This not only reduces the electrical effectiveness of the microwave source but indeed may caused physical damage of the waveguide as such standing arcs actually may create enough heat and energy to deform or even burn through the waveguide itself.

The present invention seeks to eliminate these difficulties through a passive arc suppression technique. The invention is applied to a waveguide section that has a relatively high point in a waveguide run between the oven cavity and the power source, preferable in an unpressurized waveguide run, where backward electromagnetic movement of the arc would involve a downward movement in elevation.

In a preferred embodiment, an H field bend is formed at or near this position in the waveguide. By forming small vent holes in the upper portion of the H-bend at this point, the heat associated with the arc is allowed to rise and escape through the vent holes. The action of the escaping arc gasses tends to draw the arc upward toward the side wall of the H-bend at this point in the waveguide. The side wall of the H-bend at this point, however, presents a voltage of zero volts. This reduction in voltage at the location of the arc allows the arc to in turn naturally extinguish itself The arc is therefore naturally extinguished as the heat escapes, without the use of arc detectors, power source controllers and the like that would otherwise interrupt the continuous operation of the microwave power source.

The invention can be used with many different types of microwave systems. For certain classes of industrial microwave ovens that use hot air processing as well as microwave processing, the introduction of hot air into the microwave oven cavity tends to exacerbate the arcing problem, since hot air is more readily ionized than ambient temperature air. The inclusion of vent holes in such systems is therefore effective in increasing their microwave heating efficiency.

DETAILED DESCRIPTION OF PREFERRED EMBODIMENTS

Figure 1:
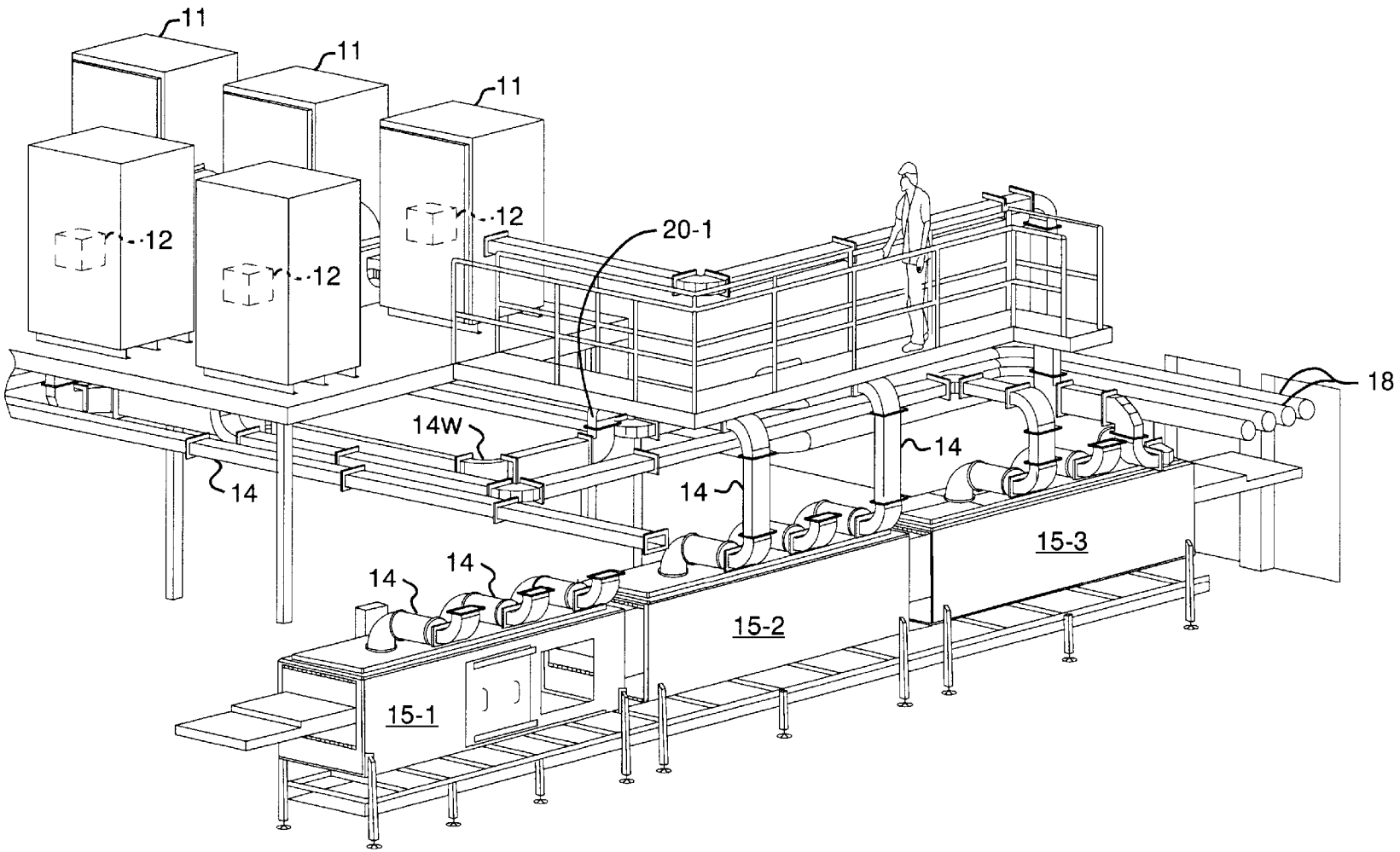
FIG. 1 is a perspective view of a microwave cooking system that makes use of a passive arc suppression technique according to the invention.

Turning attention now to the drawings more particularly, FIG. 1 illustrates an oven system 10 that may be used in a continuous feed industrial type application. The oven system 10 includes a number of cabinets 1I1 that enclose microwave energy sources 12. Waveguide runs 14 of various types act as conduits for carrying microwave energy generated by the energy sources to the interior of a number of oven cavities or enclosures 15-1, 15-2, 15-3 (collectively, the enclosures 15). The present invention is related in particular to how the waveguides 14 may be structured to suppress the generation of arcs within them.

Shown is a continuous feed oven system 10 in which a series of three oven enclosures 15-1, 15-2 and 15-3 are provided. A door assembly 16 may be included on one or more of the enclosures 15 through which access may be provided to facilitate cleaning of the ovens.

The waveguide runs 14 are only partially shown for clarity. For example, the waveguides 14 above enclosure 15-1 appears to be open in the drawing, whereas they actually form a continuous connection between the microwave energy sources 12 and the enclosures 15. It can also be seen that multiple energy sources 12 and waveguides 14 can be used to feed a given one of the enclosures 15.

In addition, although the illustrated system 10 provides for cooking by microwave energy, the system 10 could also provide for cooking through hot air heating by convection.

Of particular interest in FIG. 1 is a bent waveguide section 20-1 which forms a part of waveguide run 14-W. As more fully explained below, the bent waveguide section 20-1 is at a location in the waveguide run 14-W at which an arc might be expected to set up in a stable position. The present invention eliminates or supresses the arc through a passive arc suppression technique. The invention can typically be applied to a bent waveguide section 20-1 that is located in a relatively high point in the waveguide run 14-W between the oven enclosure 15 and the power source 12.

In a preferred embodiment, the bent waveguide section 20-1 is an H field bend located at or near this relatively high position of the waveguide 14-W. Vent holes (not shown in FIG. 1) are formed in the H-bend waveguide 20-1 in an appropriate location. These vent holes assist in suppressing an arc located the particular section of the waveguide 14-W in which the bent waveguide section 20-1 is located.

Figure 2:
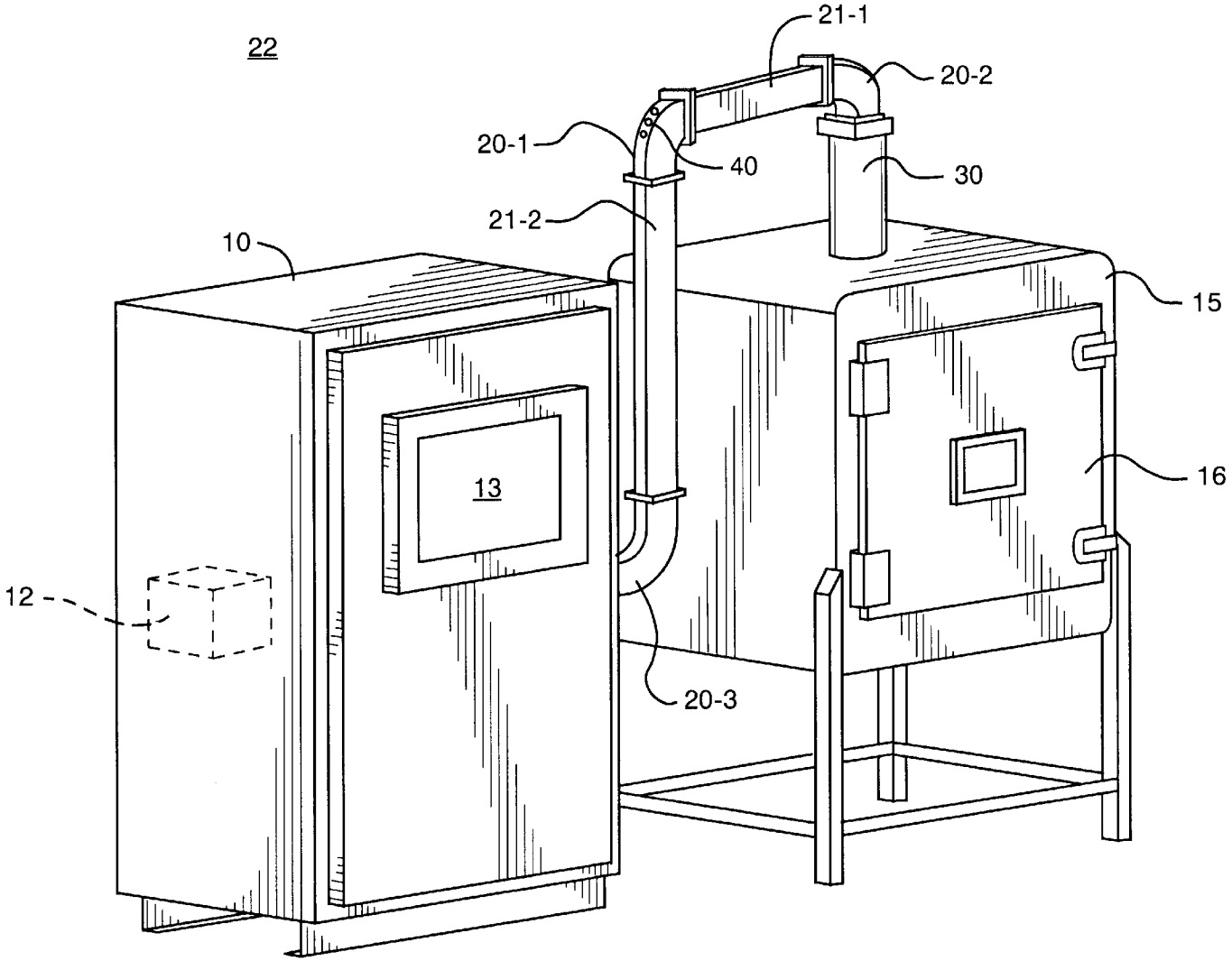
FIG. 2 is a smaller scale batch oven which may also make use of the invention.

A similar vented bent waveguide section 20-1 is used in the oven system shown in FIG. 2. This figure illustrates a smaller batch type oven 22 that contains a single cabinet 11 having placed therein a microwave energy source 12. A control panel 13 may be accessed by an operator to control the operation of the batch oven 22.

The batch oven 22 makes use of a circularly polarized feed assembly 30 to couple microwave energy to its respective enclosure 15 such that energy originating from the rectangular waveguides 14 are presented to the cavity with a generating circularly polarized orientation. This prevents the supplied microwave energy from coupling to fixed modes internal to the enclosure 15. For more information on the type of polarizing assembly 30 and the batch oven 22 more generally, reference can be made to U.S. Pat. No. 6,034,362 issued Mar. 7, 2000 to Alton.

Feeding the polarizing assembly 30 is a waveguide run 14 that consists of a series of rectangular waveguide sections including H-bend waveguide sections 20-1, 20-2, and 20-3, and straight waveguide sections 21-1 and 22-2. Of interested in this particular arrangement is the H-bend waveguide section 20-1 which is located in a relatively high point in the waveguide run 14. As can be seen in FIG. 2, this particular waveguide section 20-1 has vent holes 40 formed in an upper portion thereof.

Figure 3:
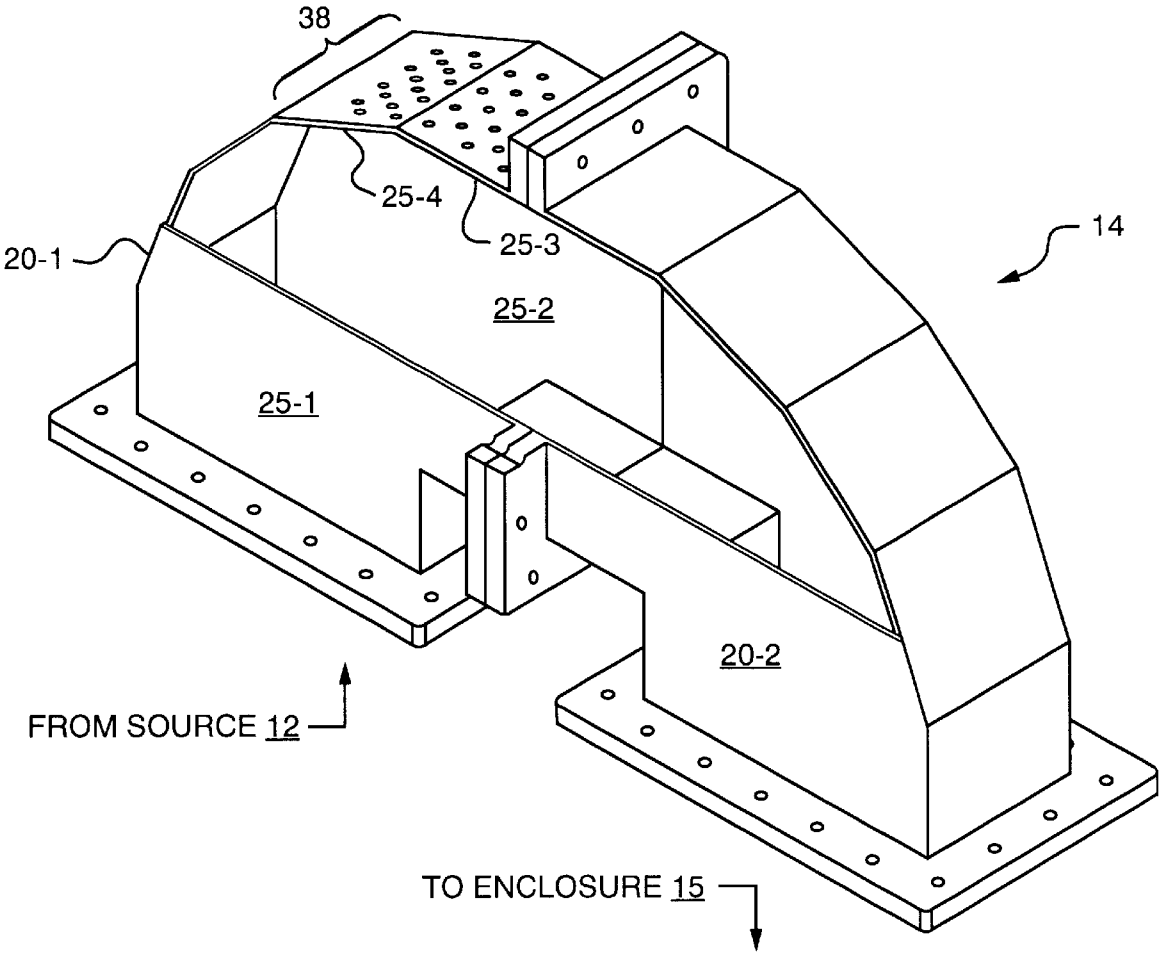
FIG. 3 is a partially cut away perspective view of a waveguide section having a high point formed therein that tends to trap arcs, showing the location of the vent holes.

To understand how the placement of vent holes 40 assists with the suppression of arcs within the waveguide run 14, turn attention now to FIG. 3. Shown here is a simple waveguide run 14 made up of a pair of H-bend waveguide sections 20-1 and 20-3. The waveguide run 14 normally carries electromagnetic energy in a forward direction from the microwave power source 12 towards the enclosure cavity 15. (It should be understood that the arrangement in FIG. 3 is a simplification of the waveguide runs 14 shown in FIGS. 1 and 2; in practice it is often necessary because of mechanical constraints to have multiple straight and bent waveguide sections in any given waveguide run 14, such as was shown in FIG. 1.).

FIG. 3 also illustrates how the waveguide run 14 presently has an arc 35 formed therein. The arc 35 is represented schematically in FIG. 3 as a low impedance short between the two major side surfaces 25-1 and 25-2 of the waveguide 14. In a common scenario, the arc 35 has originated in a section of the waveguide run 14 near or in the cooking cavity 15, such as in a place below the waveguide section 20-2. Because the power source 12 represents a region of lower impedance, the arc 35 then tends to travel backwards through the waveguide run 14 towards the power source 12 in a reverse direction The arc 35 acts to reflect at least some electromagnetic energy back to the power source 12. This causes a decrease in power levels at points in the waveguide 14 beyond the arc 35, resulting in a situation where the cavity 15 in turn receives electromagnetic energy at a reduced power level.

The arc 35 tends to heat the air in its immediate vicinity within the waveguide 14. Since hot air rises, an arc will also tend to rise due to the heat in the ionized gases of the arc. When an arc, traveling backwards towards the power source 12, encounters a bend in the waveguide, such as within bend 20-1, certain behavior is observed under certain conditions. In particular, when the arc 35 moves into a bend 20-1 where further travel backwards towards the source 12 would involve moving downward in elevation, the arc 35 will become trapped by the rising effect of the hot air opposing the backwards movement of the arc 35.

Such an arc 35 may therefore tend to set up in a stationary or stable location within the bent waveguide 20-1 where further backwards travel towards the source 12 would involve a downwards movement in elevation. This not only reduces the electrical effectiveness of the microwave source 12 but indeed may caused physical damage of the waveguide run 14, as such standing arcs 35 actually may create enough heat and energy to deform or even burn through the waveguide 14 itself.

Such an arc is therefore normally an extremely undesirable situation within the waveguide run 14 because the ionization created by the arc 35 not only substantially reduces the power handling capacity of the waveguide 14, but may also lead to physical damage of the waveguide section 20-1.

However, in accordance with the invention, vent holes 40 are formed in a suitable upper portion 38 of the waveguide section 20-1 near where the arc 35 tends to become trapped. The vent holes 40 serve as a mechanism for passive suppression of the arc 35 through a combination of physical results. In the preferred embodiment, these vent holes 40 are optimally located at a point in the waveguide 14 where the arc would tend to normally become trapped, and have to travel downward to continue its motion back towards the power source 12.

By appropriately configuring the holes 40, the hot air (which initially caused the arc 35 to be trapped within the waveguide section 20-1), will eventually escape through the holes 40. As this release of the heated air occurs, the arc also tends to physically be drawn upwards towards the upper sidewalls 25-3 and 25-4 of the waveguide section 20-1. If the waveguide section 20-1 is appropriately designed at this point from an electromagnetic perspective, such that the sidewalls present a region of zero voltage to the arc 35, as the arc 35 is drawn towards the upper sidewalls 25-3 and 25-4, it will extinguish itself naturally.

In a more complicated waveguide run 14 consisting of several such bent sections 20-1 that present an arc trap point, the vent holes 40 are preferably located at the trap point located closest to the cavity enclosure 15 where the arcs 35 originate. This prevents standing arcs occurring closest to the enclosure from damaging such waveguide sections.

Figure 4A:
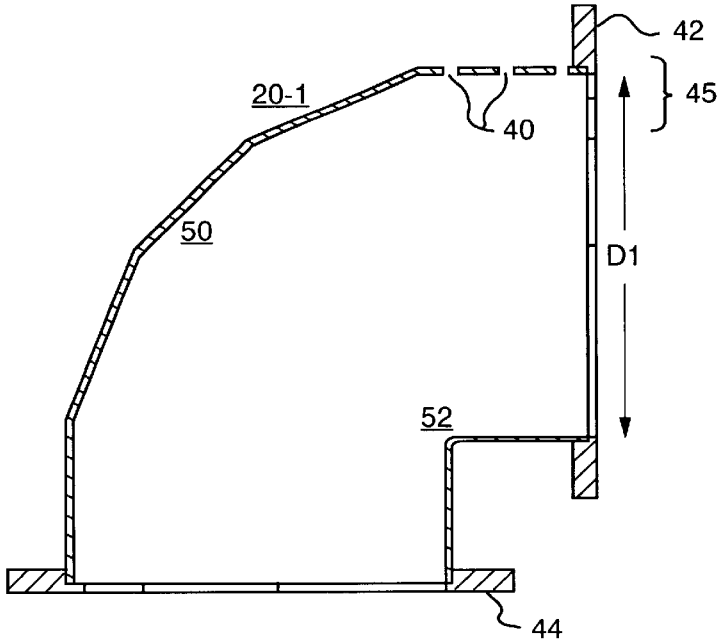
FIGS. 4A, 4B and 4C show more detailed views of an H-bend waveguide section having vent holes in an area of zero voltage.
Figure 4B:
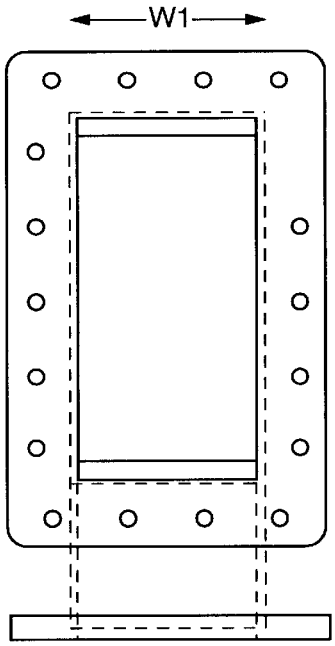
Figure 4C:
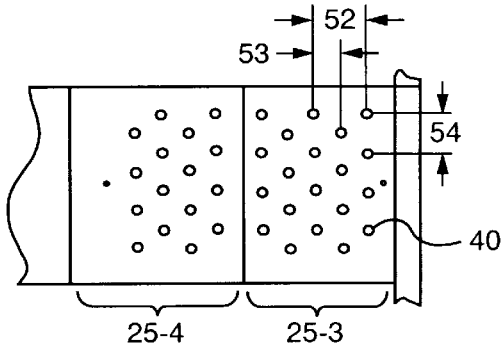

One particular type of bent waveguide section 20-1 that can be used is shown in more detail in FIGS. 4A, 4B and 4C. This bent section illustrated is an H-bend type waveguide section 20-1 previously shown as 20-1 in FIG. 1 and 20-2 in FIG. 2. A so-called H-bend section has the axis of its bend along its respective H-plane. The H-bend section 20-1 consists of an upper flange 42 and lower flange 44 to enable coupling of the H-bend section 20-1 to other sections of waveguide 14. The H-bend section 20-1 is formed preferably of aluminum one-eighth of an inch thick with a chromate golden finish per, for example standard MIL-C-5541 Class 3.

The H-bend section 20-1, generally rectangular in cross section, has vent holes 40 formed in an upper portion 45 thereof such as at the upper walls 25-3 and 25-4. For 5 operation at an intended microwave frequency of approximately 900 MegaHertz (MHz), the waveguide section 20-1 may have a length dimension, D1, of approximately 9.75 inches and width dimension, W1, of approximately 4.8 inches.

The holes 40 formed in the upper portion 45 of the H-bend 20 are large enough to permit hot air gas to escape there through but small enough to prevent the escape of microwave energy in the operating frequency band. For operation at approximately 900 MHz, the holes 40 may typically be 0.25 inch in diameter and located on a grid spacing, S1, of approximately 1 inch in the narrow dimension of the waveguide, and a grid spacing, S2, of approximately 1.4 inches along the wide dimension. The space between the adjacent columns, along dimension S3, is typically one-half of the dimension S2, or as illustrated is 0.7 inches.

Although not shown in the drawings, it can be useful in practice to attach a fine mesh screen over the holes 40 to prevent objects from clogging the vent holes or entering the waveguide section 20-1.

Figure 5:
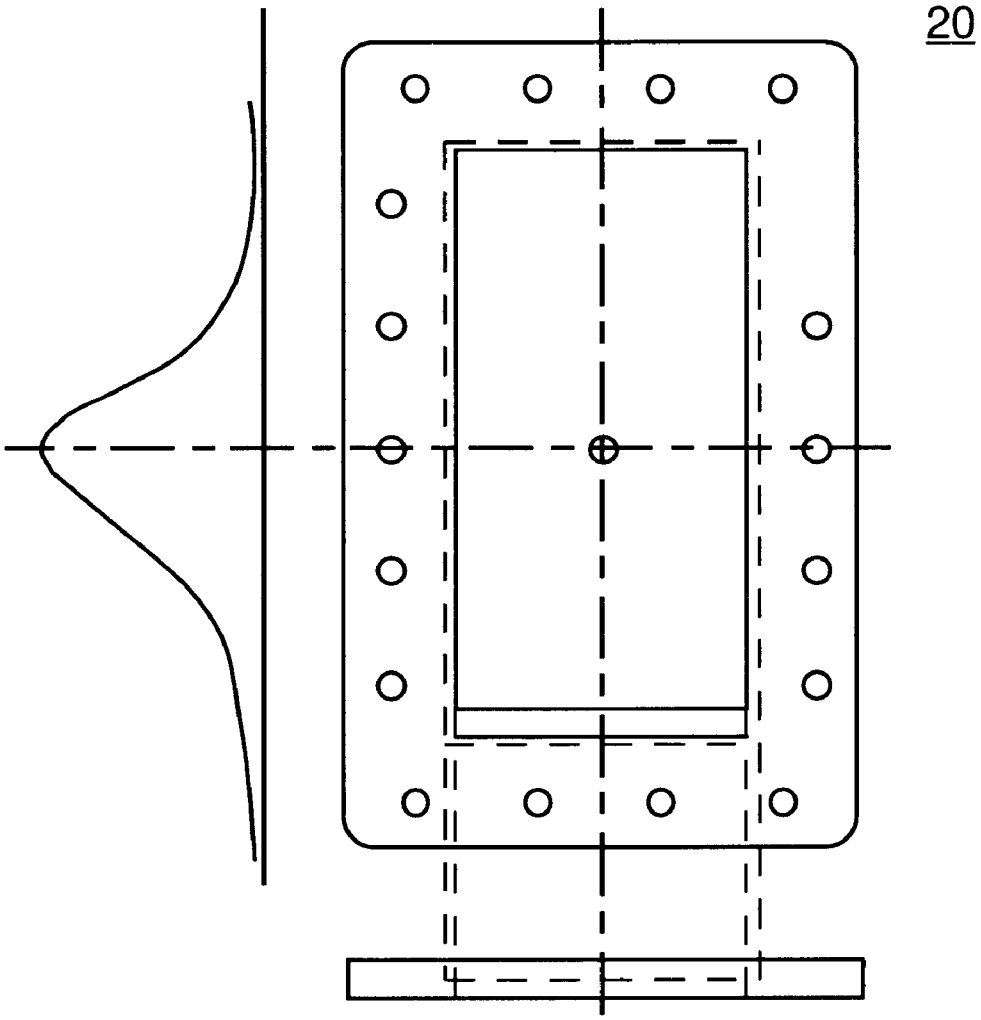
FIG. 5 is another view of the H-bend showing how a voltage vector is created within the waveguide.

Turning attention to FIG. 5 there is seen another view of the H-bend section 20-1 with a schematic view of the voltage vector V displayed adjacent to it. The voltage vector V reaches a peak value within the interior of that section 20, tapering to approximately zero volts at outer edges thereof. The zero voltage region with vent holes 40 along the outer bend 50 tends to draw the arc 35 towards it, causing the arc 35 to extinguish itself as the hot air ionized gas escapes through the vent holes 40.

While this invention has been particularly shown and described with references to preferred embodiments thereof, it will be understood by those skilled in the art that various changes in form and details may be made therein without departing from the scope of the invention encompassed by the appended claims. For example, other shapes of H-bends can accomplish the same results.

What is claimed is:

1. An oven system for cooking food through the use of microwave energy comprising:

a microwave source, for generating microwave energy at a frequency appropriate for cooking;

a cooking cavity, for holding food to be cooked; and a waveguide run for carrying the microwave energy from the microwave source towards the cooking cavity, the waveguide run comprising at least one bent waveguide section located at a relatively high point within the waveguide run, the bent waveguide section having a region with vent holes formed therein, wherein the bent waveguide section is furthermore arranged electromagnetically to present a region of relatively low voltage adjacent the vent hole region, such that the bent waveguide section passively suppresses an arc formed within the waveguide run.

2. A system as in claim 1 wherein the best waveguide section is located at a position within the waveguide run such that an arc would have to travel downward in elevation to move towards the microwave energy source.

3. A system as in claim 2 wherein the low voltage region extinguishes an arc trapped within the bend.

4. A system as in claim 1 wherein the best waveguide section is oriented such that it tends to trap an arc within the bend.

5. A system as in claim 1 wherein the best waveguide section is a rectangular waveguide H-field bend.

6. A system as in claim 5 wherein the H-field bend is oriented such that the shorter dimension of the H-field bend is oriented to a top-most portion of the bend, to present the region of relatively low voltage and the vent holes at the top-most portion of the bend.

7. A waveguide run for carrying microwave energy from a microwave source, the waveguide run comprising a bent waveguide section that passively suppresses an arc formed within the waveguide run, the bent waveguide section located at a relatively high point within the waveguide run wherein the bent waveguide section is a rectangular waveguide section having an H-bend formed at the relatively high point, and there being vent holes formed in the bent waveguide section at such relatively high point in the waveguide run.

8. A waveguide as in claim 7 wherein the vent holes are located in a position of the waveguide section adjacent to a location of relatively low voltage inside the bent waveguide section.

9. A waveguide as in claim 7 wherein the vent holes are sized to prevent microwave energy from escaping from the waveguide.

10. A waveguide as in claim 7 wherein the relative high point is at a location in the waveguide where the arc would have to travel downward in elevation in order to continue backwards movement towards the microwave energy source.

11. A waveguide as in claim 10 wherein the arc is urged in one direction along the waveguide by electromagnetic field force, and in another direction by hot air gases escaping through the vent holes.

12. A waveguide as in claim 7 arranged to provide microwave energy from a microwave energy source to a cooking cavity.

13. A waveguide as in claim 12 wherein the cooking cavity is also heated by convection heating.

14. A waveguide as in claim 7 wherein the waveguide run comprises multiple bent waveguide sections located at a position such that further backward movement of an arc would involve a downward movement in elevation, and wherein the vent holes are located in the bent waveguide section closest to a location where such arcs originate.

* * * * *